US005366387A

United States Patent [19]

Yamanashi

[11] Patent Number: 5,366,387

[45] Date of Patent: Nov. 22, 1994

[54] WATERPROOF CONNECTOR

[75] Inventor: Makoto Yamanashi, Shizuoka, Japan

[73] Assignee: Yazaki Corporation, Japan

[21] Appl. No.: 21,598

[22] Filed: Feb. 24, 1993

[30] Foreign Application Priority Data

Feb. 28, 1992 [JP] Japan ..... 4-043640

[51] Int. Cl.[5] ..... H01R 13/52

[52] U.S. Cl. ..... 439/468; 439/595; 439/752

[58] Field of Search ..... 439/468, 488, 279, 595, 439/752

[56] References Cited

U.S. PATENT DOCUMENTS 4,284,320 8/1981 Nix et al. ..... 439/752 X 5,139,431 8/1992 Saitoh et al. .

FOREIGN PATENT DOCUMENTS 3705739 8/1987 Germany ..... 439/488

472476 6/1992 Japan .

*Primary Examiner*—Eugene F. Desmond

[57] ABSTRACT

A connector housing has a plurality of terminal receiving chambers. Each of the terminal receiving chambers has a terminal inserting opening. A holder is removably attached to the terminal inserting opening to prevent the terminals from getting out of the terminal receiving chambers. The holder comprises a spread preventing portion for preventing a bundle of wires extending from the terminals from unnecessarily spreading out. A waterproof cover engages with the connector housing for covering the terminal inserting opening and the bundle of wires extending from the terminals.

5 Claims, 6 Drawing Sheets

WATERPROOF CONNECTOR

BACKGROUND OF THE INVENTION

This invention relates to a waterproof connector having a waterproof cover for electric wires.

U.S. Pat. No. 5,139,431 discloses the waterproof connector of this type, which is illustrated in FIG. 1.

FIG. 1 shows a longitudinal sectional view of the conventional waterproof connector. This waterproof connector connects wires between a door and the body in a vehicle. The waterproof connector comprises a male connector 1 and a female connector 3. The male connector extends from a door (not shown) while the female connector 3 is withdrawn in the body (not shown). The male connector 1 has a clamping bolt 5 penetrating therethrough. The male connector 1 also comprises a waterproof cover 7 which covers one end thereof and the wires therein. The female connector 3 has a built-in nut (not shown) for threadedly engaging the clamping bolt 5 of the male connector 1. The female connector 3 is, for example, mounted on an inner surface of a dash board 9. The dash board 9 has an opening 11 where a connecting portion 13 of the female connector 3 appears. The male connector 1 is coupled with the female connector 3 by means of threadedly engaging the clamping bolt 5 of the male connector 1 to the nut in the female connector 3.

In the above mentioned waterproof connector, the male connector 1 comprises a connector housing 15. The connector housing 15 has an end 8 with an opening (not shown). The electric wires 6, each of which has a terminal (not shown) connected at the end thereof, are contained a predetermined terminal receiving chamber in the connector housing 15 through the opening. The waterproof cover 7 is attached to the male connector 1 with the wires 6 bundled up and bent along the configuration of the cover 7.

The bundle of wires may, however, spread out of its proper position under the free or unrestricted condition. In other words, the force applied to the bent wire results in outward shifting thereof to the periphery of the male connector 1. Such force may be large enough to cause a slight space or gap between the waterproof cover 7 and the male connector 1, only with degrading the sealing performance therebetween.

In order to overcome the above mentioned problem, we can think that the connector housing 15 comprises spread preventing walls 21*a* and 21*b* as illustrated in FIG. 2 to prevent the wires from unnecessarily shifting. The spread preventing walls 21*a* and 21*b*, integrally formed with arid projected from the connector housing 15, can prevent the wires 6 from unnecessarily spreading outward. However, the spread preventing walls 21*a* and 21*b* may hinder the insertion of the terminals into the connector housing 15 through the opening.

SUMMARY OF THE INVENTION

An object of the present invention is to provide a waterproof connector which enables the prevention of unnecessary spread of the wires bundled up and bent n a waterproof cover, thereby keeping the sealing performance thereof with no possibility of hindering the insertion of the terminals into the connector housing.

In order to achieve the above mentioned object, the present invention provides a waterproof connector comprising: a connector housing having a plurality of terminal receiving chambers, each of the terminal receiving chambers having a terminal inserting opening; a holder removably attached to the terminal inserting opening to prevent the terminal from getting out of the terminal receiving chambers, the holder including a spread preventing portion for preventing a bundle of wires extending from the terminals from unnecessarily spreading out; and a waterproof cover engaged with the connector housing for covering the terminal inserting opening and the bundle of wires extending from the terminals.

Each terminal is inserted in the connector housing with the holder removed therefrom so that it is possible to insert the terminal without considering the spread preventing portion. After completion of the insertion off the terminals, the holder is engaged with the opening on one end of the connector housing and locked thereto, thereby preventing the terminal from getting out of the terminal receiving chamber. In this event, the wires can be bundled up and bent while preventing the wires from unnecessarily spreading or shifting with the spread preventing portion projected from the connector housing. Thus, the waterproof cover can be readily attached to the connector housing with keeping the sealing performance thereof.

BRIEF DESCRIPTION OF THE INVENTION

DESCRIPTION OF THE PREFERRED EMBODIMENT

An embodiment of the present invention will be described with reference to the accompanying drawings hereinafter.

Figure 1:
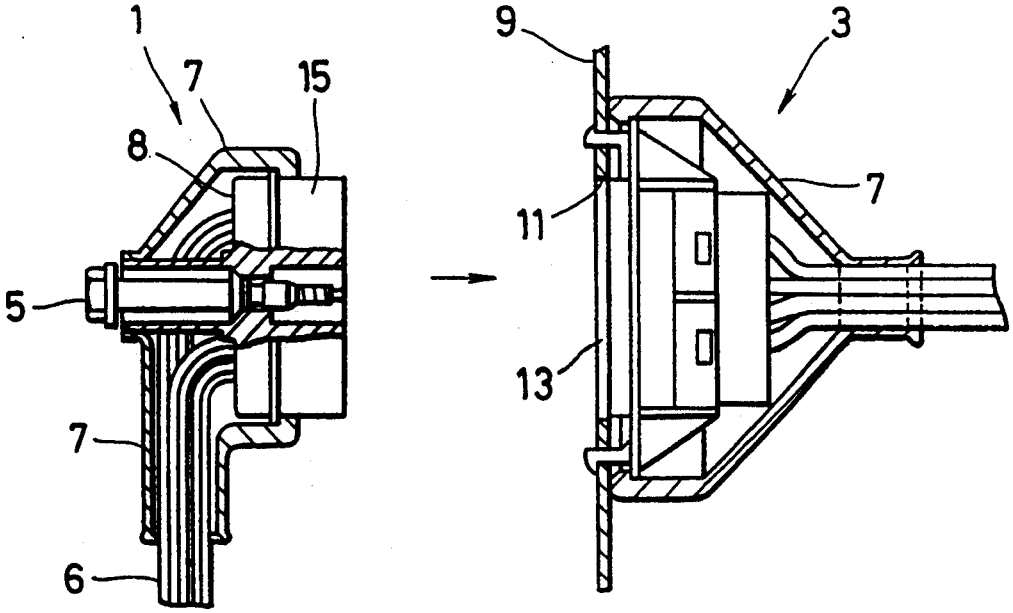
FIG. 1 PRIOR ART
FIG. 1 is a longitudinal sectional view of a conventional waterproof connector.
Figure 2:
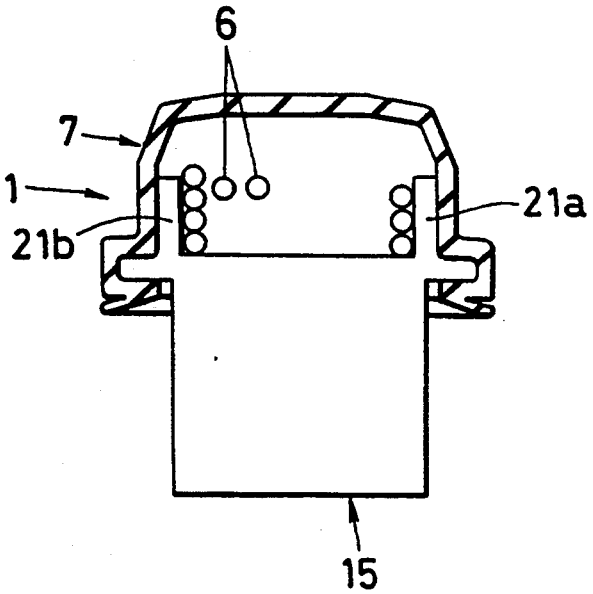
FIG. 2 is a sectional view of an embodiment of a waterproof connector having spread preventing walls.
Figure 3:
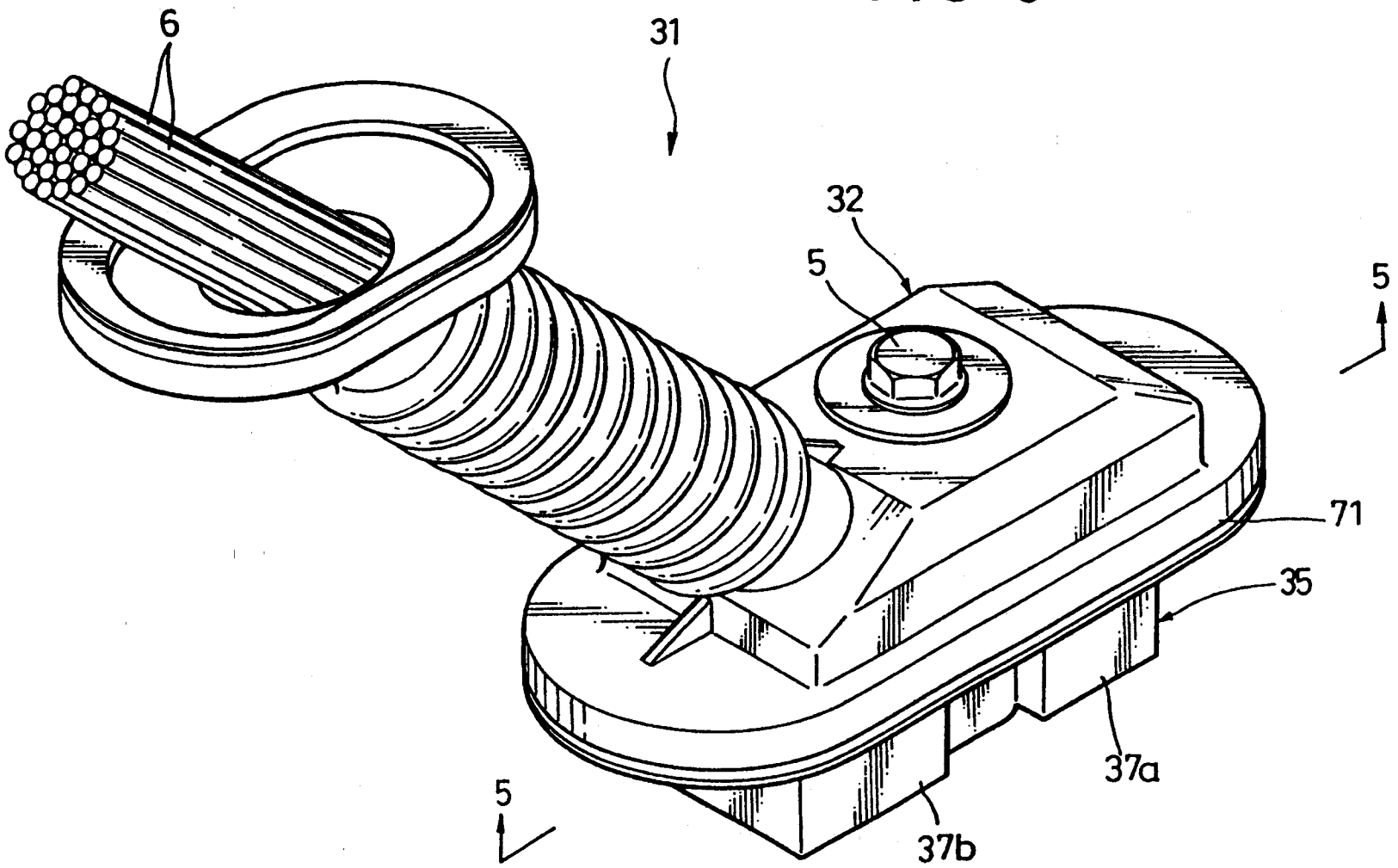
FIG. 3 is a perspective view of a waterproof connector according to an embodiment of the present invention.
Figure 4:
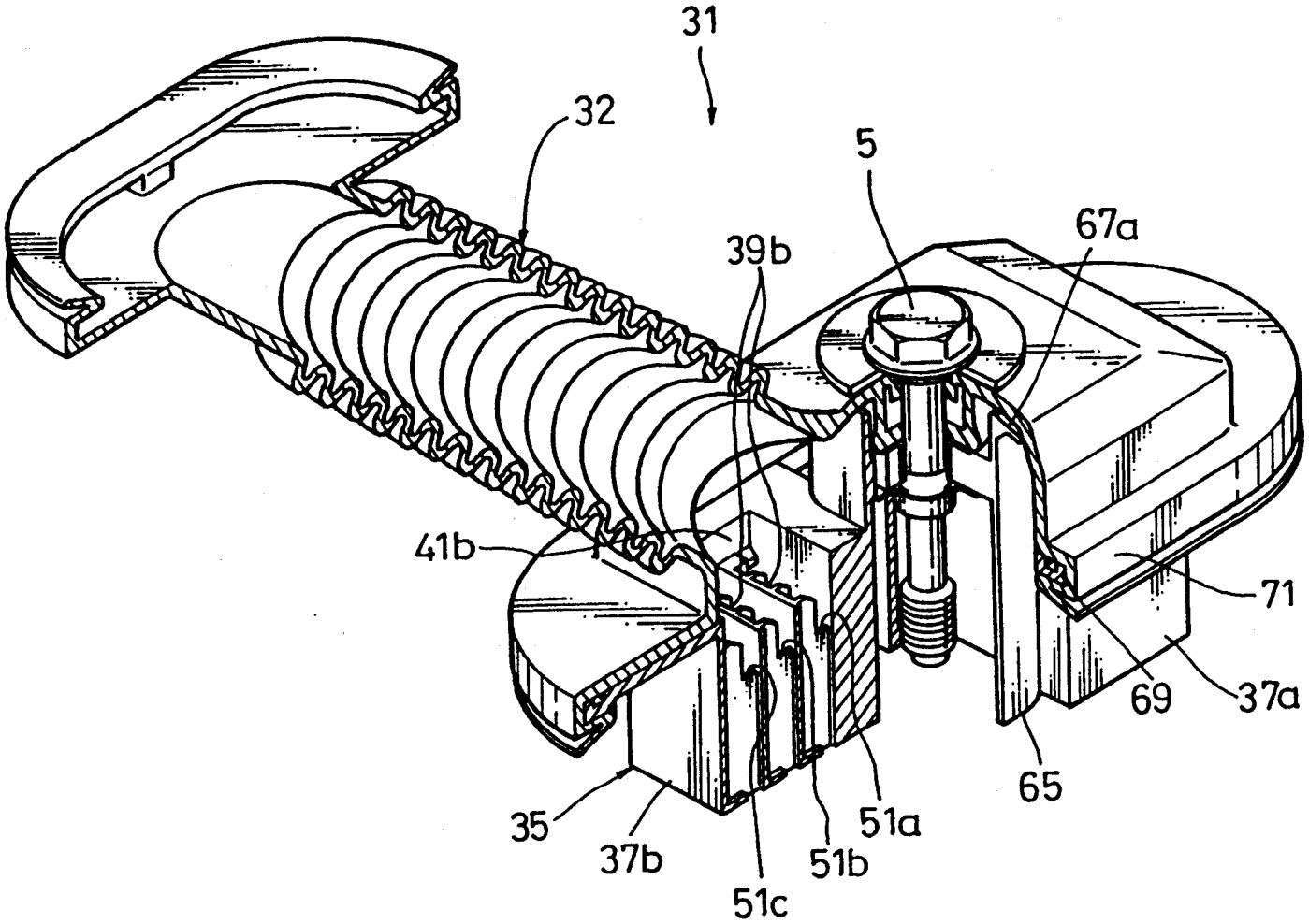
FIG. 4 is a partially cutaway perspective view of the waterproof connector illustrated in FIG. 3.
Figure 5:
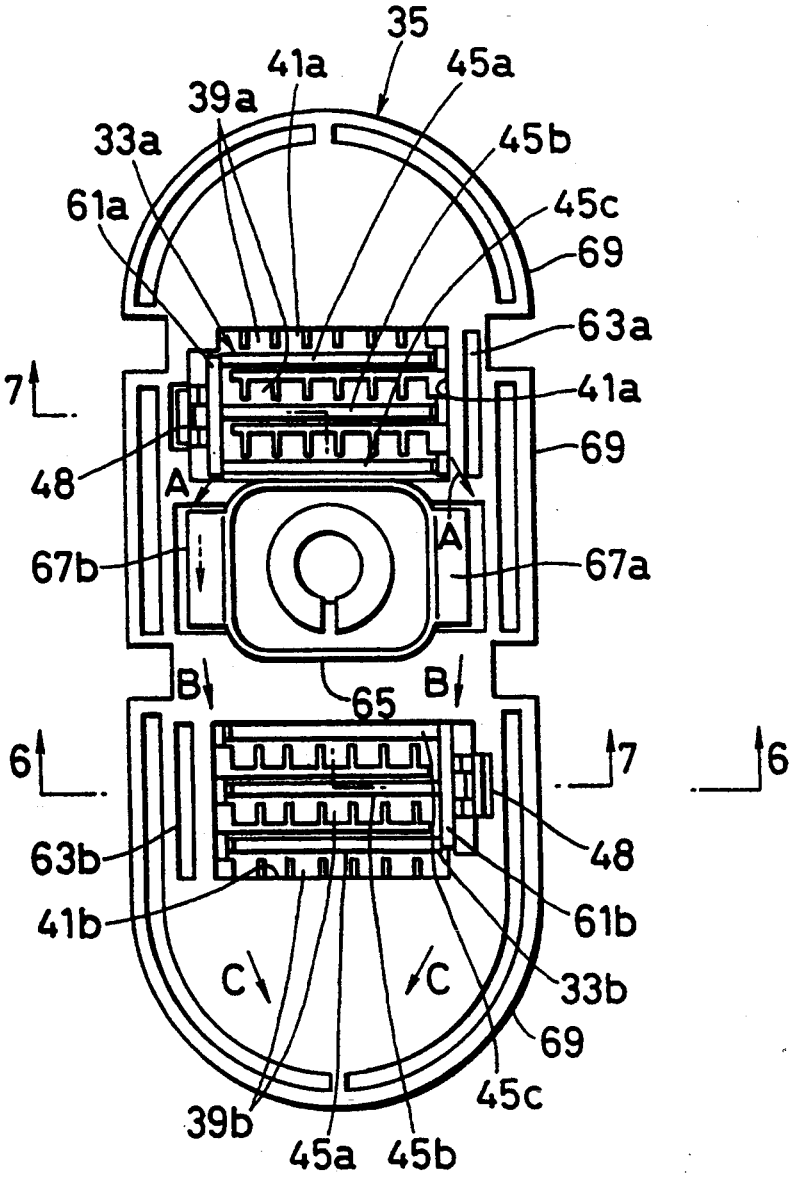
FIG. 5 is a view taken on line 5—5 in FIG. 3.
Figure 6:
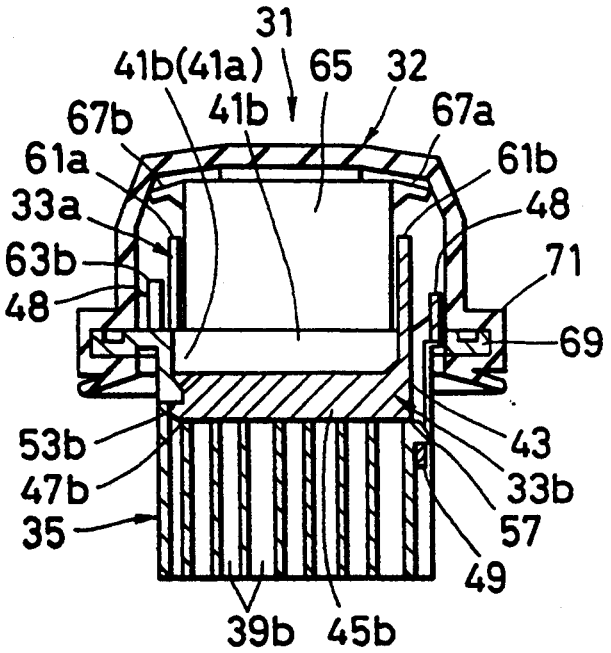
FIG. 6 is a sectional view taken on line 6—6 in FIG. 5.
Figure 7:
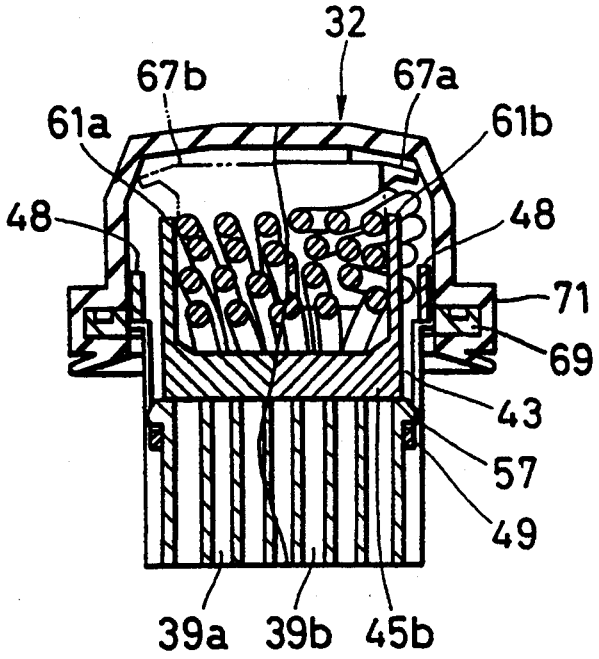
FIG. 7 is a sectional view taken on line 7—7 in FIG. 5.
Figure 8:
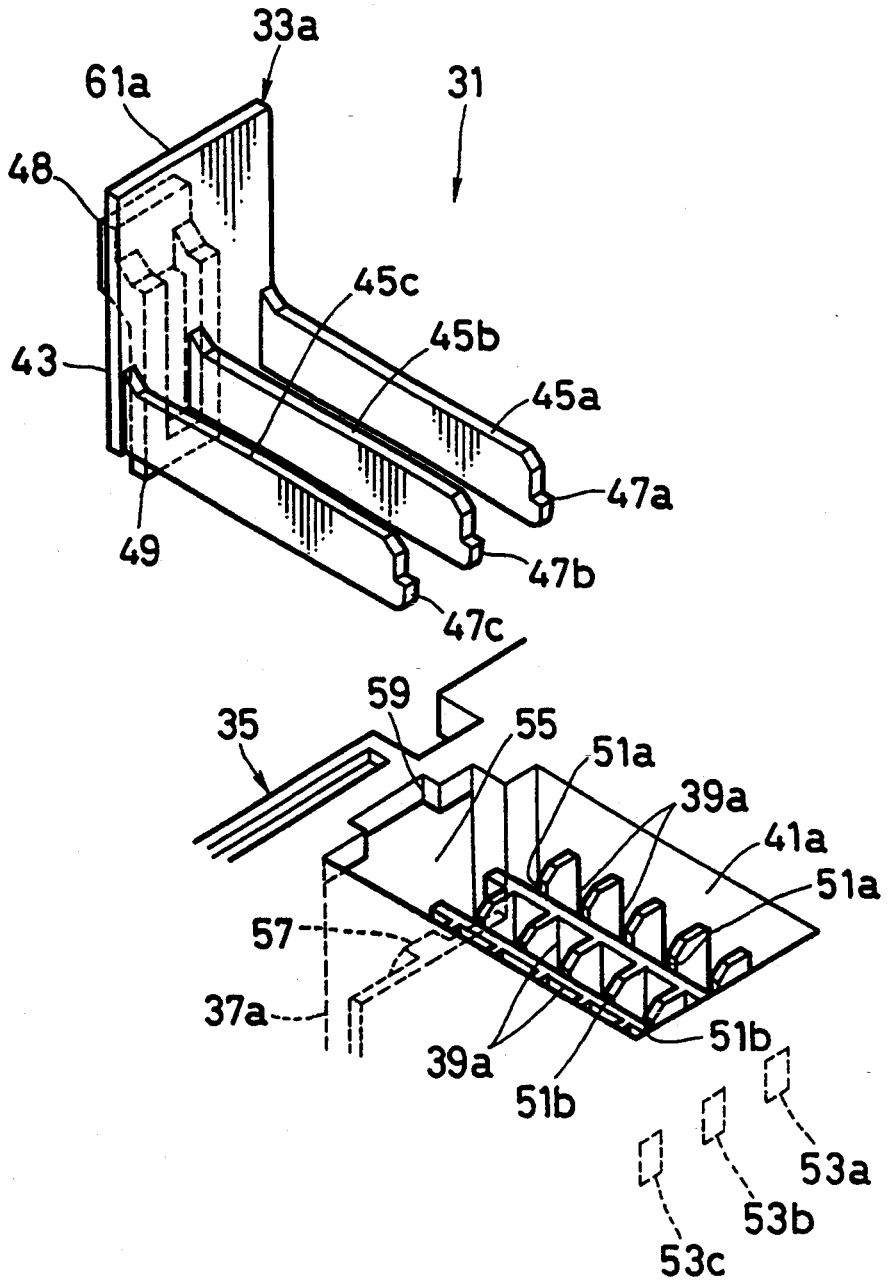
FIG. 8 is a perspective view showing a terminal inserting opening of a connector and a holder to be attached to the terminal inserting opening included in the waterproof connector according to the embodiment.

FIGS. 3 and 4 show in perspective the entire structure of a waterproof connector 31, in which FIG. :3 shows the entire appearance thereof while FIG. 4 shows partially cutaway view thereof. In addition, FIG. 5 shows a front view of the waterproof connector 31, of which sections are shown in FIGS. 6 and 7 as the views taken on lines 6—6 and 7—7 in FIG. 5, respectively. FIG. 8 is a perspective view of a part of the waterproof connector at one end thereof and a holder 33*a*. The waterproof connector 31 comprises similar parts and components to the male connector 1 illustrated in FIG. 1.

The waterproof connector 31 comprises a connector housing 35. The connector housing 35 has two compartments 37*a* and 37*b* for terminal receiving chambers as illustrated in FIGS. 3 and 4. Each of the compartments 37*a* and 37*b* has a plurality of terminal receiving chambers 39*a* and 39*b* as shown in FIGS. 4 through 7.

The connector housing 35 also comprises rectangular openings 41*a* and 41*b* at one end thereof to open the terminal receiving chambers 39*a* and 39*b* at the rear end of the compartments 37*a* and 37*b*, respectively. The holder 33*a* is engaged with the opening 41*a* and locked thereto. Similarly, the other holder 33*b* is engaged with the opening 41*b* and locked thereto. These holders 33*a* and 33*b* are for use in preventing the terminals from getting out of the terminal receiving chambers 39*a* and 39*b*, respectively. The holder 33*b* is similar in structure and in engaging operation to the holder 33*a*. Accordingly, only the holder 33*a* will be described below and the description of the holder 33 will be omitted.

As shown in FIG. 8, the holder 33*a* has a base plate 43. Three legs 45*a*, 45*b* and 45*c* are projected from one surface of the base plate 43. The legs 45*a*, 45*b* and 45*c* comprise engaging protrusions 47*a*, 47*b* and 47*c*, respectively, at each extremity thereof. A holding portion 48 is formed on the other surface of the base plate 43 where the legs are not projected. An engaging hook 49 disposed on the lower end of the holding portion 48.

Steps 51*a*, 51*b* and 51*c* are formed in the compartment 37*b* (see FIG. 4) to receive the legs 45*a*, 45*b* and 45*c*, respectively, between the terminal receiving chambers 39*b*. Engaging grooves 53*a*, 53*b* and 53*c* are formed on the surface of the compartment 37*a* (see FIG. 8) at a position corresponding to the steps 51*a*, 51*b* and 51*c* to receive the engaging protrusions 47*a*, 47*b* and 47*c*, respectively. A window 55 is formed on the opposite surface to where the engaging grooves 53*a*, 53*b* and 53*c* formed. The connector housing 35 comprises an engaging projection 57 on the inner surface thereof. The engaging projection 57 is formed at a lower portion of the window 55 to engage the engaging hook 49 of the holder 33*a*. In addition, the window 55 has a recess 59 at the upper portion thereof to receive the holding portion 48 of the holder 33*a*.

In the preferred embodiment of the present invention, the base plate 43 comprises a first spread preventing portion 61*a* integrally formed therewith at the upper portion thereof. The first spread preventing portion 61*a* is projected from the opening 41*a* as shown in FIG. 6. Thus, the first spread preventing portion 61*a* can prevent the bundle of the wires 6 (FIG. 4) from unnecessarily spreading to the periphery of the connector housing 35 as described below. The first spread preventing portion 61*a* consists of a wall portion extending along the terminal inserting direction.

The holders 33*a* and 33*b* are spaced apart and diagonally opposite to each other as shown in FIG. 5. The clamping bolt 5 is interposed between the holders 33*a* and 33*b*. Thus, the first spread preventing portion 61*a* is diagonally opposed to the first spread preventing portion 61*b*.

Second spread preventing portions 63*a* and 63*b* are projected from the surface of the connector housing 35 as shown in FIGS. 5 and 6. The second spread preventing portions 63*a* and 63*b* are integrally formed with the connector housing 35 at the opposite side to the first spread preventing portions 61*a* and 61*b*, respectively. The connector housing 35 comprises a hollow cylindrical portion 65 through which the clamping bolt 5 is penetrated. The hollow cylindrical portion 65 comprises wire restricting pieces 67*a* and 67*b* projected from both sides thereof. The wire restricting pieces 67*a* and 67*b* are formed not to allow the bundle of wires 6 to rise away.

Operation for assembling the waterproof connector 31 will be described below. In the above mentioned waterproof connector 31, the holder 33*a* (33*b*) is removed from the opening 41*a* (41*b*) to insert the terminals connected to the wires 6 into the terminal receiving chambers 39*a* and 39*b* (see FIGS. 3 and 4). Accordingly, the terminals can be readily inserted into the terminal receiving chamber 39*a* (39*b*) without taking the first spread preventing portion 61*a* (61*b*) into consideration.

Subsequently, the engaging protrusions 47*a*, 47*b* and 47*c* protruded from the legs 45*a*, 45*b* and 45*c* are first inserted into the compartment 37*a* (37*b*) through the opening 41*a* (41*b*) as shown in FIG. 8. Each of the engaging protrusions 47*a*, 47*b* and 47*c* engages with the engaging grooves 53*a*, 53*b* and 53*c*, respectively. The holding portion 48 is then pushed into the compartment 37*a* (37*b*). As a result, the steps 51*a*, 51*b* and 51*c* receive the legs 45*a*, 45*b* &nd 45*c*, respectively, thereby the engaging hook 49 is engaged with the engaging projection 57. In event, the holder 33*a* (33*b*) is completely attached to the opening 41*a* (41*b*). Each of the legs 45*a*, 45*b* and 45*c* the holder 33*a* and 33*b* engages with the rear end of the terminal. Accordingly, it is possible to prevent the terminals from getting out of the terminal receiving chambers 39*a* and 39*b*.

When the holder 33*a* (33*b*) is properly attached to the opening 41*a* (41*b*), the wires 6 are bundled up along the direction depicted by arrows A, B and C in FIG. 5. The wires 6 extending from the opening 41*a* are led to the other opening 41*b*, passing by the hollow cylindrical portion 65. The led wires are bundled together with the wires extending from the opening 41*b*. In this event, the first spread preventing portion 61*a* prevents the wires 6 from unnecessarily spreading over the opening 41*a*. Similarly, the first spread preventing portion 61*b* prevents the wires 6 from unnecessarily spreading over the opening 41*b*. Thus, the diagonally opposed spread preventing portions 61*a* and 61*b* prevents the wires from unnecessarily spreading to the periphery of the connector housing 35.

In addition, the present embodiment also prevents the wires from unnecessarily spreading by means of the second spread preventing portions 63*a* and 63*b*. Further, the wire restricting pieces 67*a* and 67*b* projected from the hollow cylindrical portion 65 further restrict the bundle of wires 6. Thus, the waterproof connector according to the present invention requires smaller space for leading and bundling the wires. Accordingly, it becomes possible to prevent the waterproof connector 32 from being separated from the connector housing 35 when the waterproof cover is attached thereto. In other words, no gap is generated therebetween and higher sealing performance can be achieved.

A waterproof cover 32 engages with the periphery of the connector housing 35 to cover the openings 41*a* and 41*b*. The waterproof cover 32 also covers the wires extending from the terminals. More particularly, the connector housing 35 comprises an engaging flange 69 projected from the peripheral surface thereof and the waterproof cover 32 comprises an engaging portion 71. The engaging portion 71 engages with the engaging flange 69. The waterproof cover 32 is secured to the connector housing 35 with the clamping bolt 5. In this manner, the waterproof cover 32 can be attached to the housing 35.

While the present invention has thus been described in conjunction with the preferred embodiment thereof, it is not restricted thereto and various modifications and changing may be possible. For example, the second spread preventing portions 63*a* and 63*b* may be omitted. Instead, each of the holders may comprise a spread preventing portion which is equal in height to the spread preventing portions 61*a* and 61*b* of the holders 33*a* and 33*b*. In this event, elimination of the spread preventing portions on the connector housing results in easier operation for inserting the terminals.

What is claimed is:

1. A waterproof connector comprising:

a connector housing having a plurality of terminal receiving chambers for containing a plurality of terminals, each of said terminal receiving chambers having a terminal inserting opening and each of said terminals being connected to an electric wire;

a holder removably attached to said terminal inserting opening to prevent said terminals from being released from said terminal receiving chambers, said holder including a spread preventing portion having a plurality of holding fingers extending from a wall of the holder defining spaces of a comb for preventing a bundle of wires extending from said terminals and between said holding fingers from unnecessarily spreading out; and a waterproof cover engaged with said connector housing for covering said terminal inserting opening and said bundle of wires extending from said terminals.

2. A waterproof connector as claimed in claim 1, wherein aid spread preventing potion includes a wall portion extending in the terminal inserting direction.

3. A waterproof connector as claimed in claim 1, wherein said holder includes a base plate, a leg extending from said base plate in the direction crossing to said base plate, an engaging protrusion formed on the extremity of said leg, and an engaging hook removably engaged with said connector housing, wherein said leg contributes to preventing said terminals from being released from said terminal receiving chambers and said spread preventing portion extends from said base plate.

4. A waterproof connector comprising:

a connector housing having a plurality of terminal receiving chambers for containing a plurality of terminals, each of the terminal receiving chambers having a terminal insertion opening and a terminal insertion direction, each of the respective terminals being connected to a respective electric wire and the wires forming a bundle of wires;

a holder removably attached to the terminal insertion opening to retain the terminals in the terminal receiving chambers, the holder including a spread preventing portion for preventing the bundle of wires extending from the terminals from spreading out unnecessarily, wherein the holder includes a base plate, a leg extending from the base plate in the direction crossing to the base plate, an engaging protrusion formed on the leg at an extremity thereof, and an engaging hook removably engaged with the connector housing, wherein the leg aids retention of the terminals in the terminal receiving chambers, and the spread preventing portion extends from the base plate;

a waterproof cover engaged with the connector housing for covering the terminal insertion opening and the bundle of wires extending from the terminals; and wherein the connector housing further includes a step formed between the terminal receiving chambers for receiving the leg, an engaging groove for engaging the engaging protrusion, and an engaging protrusion for engaging the engaging hook.

5. The connector of claim 4, wherein the spread preventing portion includes a wall portion extending in the terminal insertion direction.

* * * * *